US010392901B2

(12) United States Patent
Evertsen

(10) Patent No.: US 10,392,901 B2
(45) Date of Patent: Aug. 27, 2019

(54) DOWNHOLE TOOL METHOD AND DEVICE

(71) Applicant: Wellbore AS, Tananger (NO)

(72) Inventor: Steffen Evertsen, Stavanger (NO)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 185 days.

(21) Appl. No.: 15/033,547

(22) PCT Filed: Oct. 15, 2014

(86) PCT No.: PCT/NO2014/050195

§ 371 (c)(1),
(2) Date: Apr. 29, 2016

(87) PCT Pub. No.: WO2015/065196

PCT Pub. Date: May 7, 2015

(65) Prior Publication Data

US 2016/0273307 A1 Sep. 22, 2016

(30) Foreign Application Priority Data

Oct. 30, 2013 (NO) ..... 20131434

(51) Int. Cl.
*E21B 34/12* (2006.01)
*E21B 29/00* (2006.01)
*E21B 31/12* (2006.01)

(52) U.S. Cl.
CPC ..... *E21B 34/12* (2013.01); *E21B 29/00* (2013.01); *E21B 31/12* (2013.01)

(58) Field of Classification Search
CPC ..... E21B 34/12
See application file for complete search history.

(56) References Cited

U.S. PATENT DOCUMENTS 3,332,495 A 7/1967 Young
3,592,275 A * 7/1971 Fletcher ..... E21B 17/07 173/58

(Continued)

FOREIGN PATENT DOCUMENTS

EP 0092341 A2 10/1983
WO 9746791 A1 12/1997

OTHER PUBLICATIONS

Supplementary Search Report in European Application No. 14857171, dated May 29, 2017, 3 pages.

*Primary Examiner* — David J Bagnell
*Assistant Examiner* — Brandon M Duck
(74) *Attorney, Agent, or Firm* — Perkins Coie LLP

(57) ABSTRACT

A downhole tool (1) method and device, in which the downhole tool (1) is designed to form part of a pipe string (4), and in which a valve (24) is provided with a passage (120) for fluid, the passage (120) including an opening and closing mechanism (78), and the method including: connecting a first valve portion (26) to the pipe string (4); connecting a second valve portion (28) telescopic relative to the first valve portion (26) to a downhole object (20); pre-tensioning the first valve portion (26) and the second valve portion (28) in the direction of contraction to an initial position, in which the opening and closing mechanism (78) is open; and moving the first valve portion (26) relative to the second valve portion (28) in the direction of extension to close the opening and closing mechanism (78).

21 Claims, 6 Drawing Sheets

(56) References Cited

U.S. PATENT DOCUMENTS

| | | | | |
|---|---|---|---|---|
| 3,848,629 | A | 11/1974 | Young | |
| 3,968,845 | A * | 7/1976 | Chaffin | E21B 21/00 175/60 |
| 4,100,969 | A | 7/1978 | Randermann | |
| 4,356,867 | A | 11/1982 | Carmody et al. | |
| 4,566,478 | A | 1/1986 | Deaton et al. | |
| 4,648,457 | A | 3/1987 | Ross et al. | |
| 4,842,064 | A | 6/1989 | Gazda et al. | |
| 6,889,771 | B1 | 5/2005 | Leising et al. | |
| 8,424,611 | B2 | 4/2013 | Smith et al. | |
| 2004/0140131 | A1 * | 7/2004 | Susman | E21B 4/14 175/296 |

* cited by examiner

II-II

DOWNHOLE TOOL METHOD AND DEVICE

This invention relates to a downhole-tool method. More particularly, it relates to a downhole-tool method in which the downhole tool is designed to form part of a pipe string, and in which a valve is provided with a passage for fluid, the passage including an opening and closing mechanism. The invention also includes a downhole-tool device.

The invention is particularly directed towards a valve in a hydraulic downhole tool for removing casing in a well.

The tool in question is arranged with a first fixing device and a second fixing device with an intermediate hydraulic actuator—often termed a jack—which is arranged to change the distance between the fixing devices. The actuator may be single-acting so that a possible return movement is carried out by means of a spring.

The first fixing device is arranged to be fixed to or at the end of a casing and the second fixing device is arranged to be fixed a distance from the end of the casing, typically to a surrounding casing.

Casing is removed piece by piece by a cutting tool being moved into the casing and cutting it a distance from the nearest end, so that an end length and a casing rest in the extension of the end length are formed. The end length may be several hundred meters long. The casing, and thereby the end length, may be cemented and stuck to a surrounding casing, so that great axial force must be used to pull the end length loose before it can be pulled out of the well.

Said tool with said fixing devices and actuator is lowered into the well, is attached to the upper end of the end length by means of the first fixing device and typically to the wall of a surrounding casing by a second fixing device. By means of the hydraulic actuator, the end length is pulled away from the rest of the casing. If the end length is not loose enough when the stroke length of the actuator has been spent, the operation may be repeated after having moved the tool so that the second fixing device grips further away from the rest of the casing still fixed.

As in many downhole operations, it is practical to drive a hydraulic actuator by means of a liquid, typically a drilling fluid, which is pumped through a pipe string in which the tool is included. The actuator is then hydraulically connected in such a way that fluid may flow out of a port in the pipe string and into the actuator. When pressure is to be created for driving an actuator in a downhole tool, it is known to close to the flow of drilling fluid by means of a valve, which is placed below said port. A well-known solution is to arrange a valve seat below the port and let a valve body, such as a ball, into the fluid flow. The ball follows the fluid flow, and when the ball lands in the valve seat, the fluid flow through the pipe string is blocked. The pressure at the port upstream of the valve seat may then easily be determined by means of a pump and other equipment on the surface, so that the actuator can work with the desired force.

Several solutions are known for said valve. A valve seat and a loose ball as a valve body may work well in a vertical well, but not so well in a horizontal well. Valves that are operated via a separate hydraulic circuit with associated hydraulic lines are complicated and often come into conflict with other components of the tool. Valves that are operated by the drill string being rotated have drawbacks in terms of safety because of the risk of loosening threaded connections in the pipe string so that it is no longer pressure-tight.

The invention has for its object to remedy or reduce at least one of the drawbacks of the prior art.

The object is achieved according to the invention through the features that are specified in the description below and in the claims that follow.

In a first aspect of the invention, a downhole-tool method is provided, in which the downhole tool is designed to form part of a pipe string, and in which a valve is provided with a passage for fluid, the passage including an opening and closing mechanism, the method being characterized by comprising:

- connecting a first valve portion to the pipe string;
- connecting a second valve portion telescopic relative to the first valve portion to a downhole object;
- pre-tensioning the first valve portion and the second valve portion in the direction of contraction to an initial position in which the opening and closing mechanism is open; and
- displacing the first valve portion relative to the second valve portion in the direction of extension to close the opening and closing mechanism.

The method may include displacing the first valve portion relative to the second valve portion in the direction of extension by pulling on the pipe string.

According to a second aspect of the invention, a downhole-tool device is provided, which is designed to form part of a pipe string, and in which a valve is provided with a passage for fluid, the passage including an opening and closing mechanism, the valve being characterized by a first valve portion being connected to the pipe string and a second valve portion telescopic relative to the first valve portion being connected to a downhole object, the first valve portion and the second valve portion being pre-tensioned in the direction of contraction to an initial position in which the opening and closing mechanism is open, a displacement between the first valve portion and the second valve portion in the direction of extension bringing the opening and closing mechanism to close.

The opening and closing mechanism may consist of a seat valve. One of the valve portions has an associated valve seat, and one of the valve portions is designed to, in the initial position, keep a valve body at a distance from the valve seat, a displacement between the first valve portion and the second valve portion in the direction of extension having the effect of letting the valve body come into sealing contact with the valve seat.

A valve according to the invention includes a first valve portion which, in a preferred embodiment, comprises a tubular housing, and a second valve portion which can be moved axially in the first valve portion comprises a telescope pipe which is connected to a downhole object. Movement between the valve portions works to close or open an opening and closing mechanism in the passage. When the opening and closing mechanism is open, fluid may flow through the valve. When the opening and closing mechanism is closed, fluid may not flow through the valve. Fluid that is pumped through a pipe string of which the valve forms part may optionally be stopped or allowed to pass by closing and opening the valve. When the valve is open, the fluid flow may be used for purposes such as operating equipment downstream of the valve. When the valve is closed, the fluid pressure upstream of the valve may be increased to provide hydraulic power for purposes or equipment upstream of the valve.

The opening and closing mechanism is normally kept open by means of a pre-tensioned main spring, which is arranged to displace the first and second valve portions in the direction of contraction and thereby have the effect of opening the opening and closing mechanism. The valve is thus normally open to fluid flow.

The pre-tensioning force of the main spring should be sufficient to resist normal stretching of a pipe string of which the valve forms part. When used in a vertical well, the pre-tensioning force must at least be large enough to resist the gravity of equipment hanging under the valve. The spring may be pre-tensioned to 100,000 N, 100 kN, for example.

A downhole tool, of which the valve forms part, will typically include a fishing device which can grip at the end of the casing that is to be pulled out, and a fixing device which can grip in a surrounding casing a distance from the fishing device. The valve is positioned between the fishing device and the fixing device. A hydraulic actuator or jack is arranged to be able to alter the distance between the fishing device and the fixing device. By reducing the distance between the fishing device and the fixing device, after both are fixedly engaged with the respective casings, the force from the actuator may pull the fishing device, and the casing retrieved, in the direction out of the well.

Fishing devices are known to the person skilled in the art and are not described any further. The same applies to tools that include said fixing device and actuator.

After a length of the casing that is to be pulled out has been cut and a casing length thereby has been separated from the rest of the casing, and after the fishing device has gripped the end of the casing length, a tensile force is applied to the downhole tool from the surface. The tensile force is to be larger than the pre-tensioning force of the main spring in the valve and thereby capable of pulling the telescope pipe in the direction out of the housing. Thereby the opening and closing mechanism of the valve closes and increased fluid pressure upstream of the valve becomes available for fixing the gripping tool to said surrounding casing and then for pulling the fishing device and the fished casing length in the direction out of the well by means of the actuator.

The opening and closing mechanism may consist of a slide valve; see the specific portion of the description.

The first valve portion and the second valve portion may be pre-tensioned in the direction of contraction by means of a hydraulic force, either as a force in addition to the force of the main spring or independently, for example by using the annular space in which the main spring is located as a hydraulic cylinder with necessary seals.

Between the first valve portion and the second valve portion, at least one longitudinal floating key may be arranged in order to prevent relative rotation between the valve portions.

In what follows, an example of a preferred method and embodiment is described, which is visualized in the accompanying drawings, in which.

Figure 1:
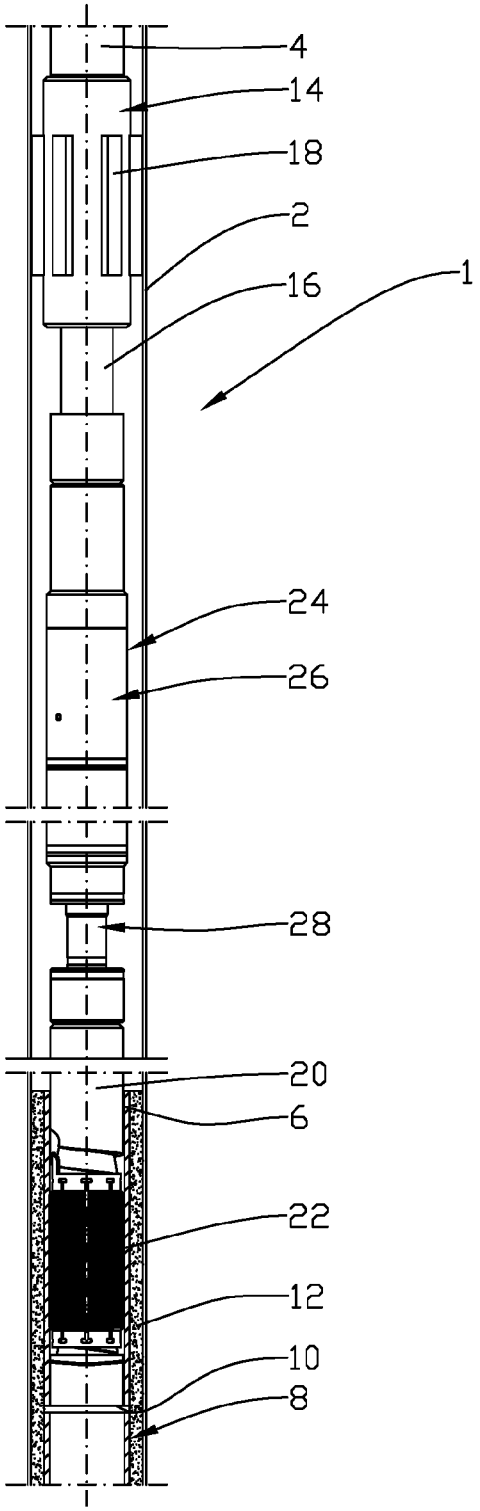
FIG. 1 shows a principle drawing of a downhole tool, which is provided with a valve according to the invention.

In the drawings, the reference numeral 1 indicates a downhole tool, which is in a surrounding casing 2. The downhole tool 1 is connected between a pipe string 4, such as a drill string, and an end length 6 of a casing 8 which has been severed from the rest of the casing 8 by a cut 10 made in advance. Cement 12 connects the end length 6 and the rest of the casing 8 to the surrounding casing 2.

The downhole tool 1 includes a hydraulic jack 14 which, at one end, is connected to the surface via the pipe string 4, and which, at the other end, has a telescopic element 16. A fixing device 18 in the form of a gripper is arranged to grip inside the surrounding casing 2 and thereby fix the hydraulic jack 14 relative to the surrounding casing 2. A hydraulic actuator not shown is arranged to displace the telescopic element 16 in the longitudinal direction when hydraulic pressure is supplied to it from fluid in the pipe string 4. The actuator is supplied with hydraulic pressure via a port not shown in the hydraulic jack 14.

The downhole tool 1 further includes a downhole object 20 in the form of a fishing device with a fixing device 22, which is arranged to grip the end length 6 at the nearest end thereof.

The hydraulic jack 14, fishing device 20 and their uses are not described any further as they are both well known to the person skilled in the art.

Between the telescopic element 16 of the hydraulic jack 14 and the fishing device 20, a valve 24 according to the invention has been positioned. An internal passage, not shown in FIG. 1, in the pipe string 4, the hydraulic jack 14, the valve 24 and the fishing device 20 forms a continuous fluid channel which makes it possible to pump fluid from the surface through the entire downhole tool.

The valve 24 includes a first valve portion 26 and a second valve portion 28 telescopic relative to the first valve portion 26. In this embodiment, the first valve portion 26 consists of a housing, and the second valve portion 28 of a telescopic pipe, which can be moved axially in the first valve portion 26 in order thereby to close or open to the flow of fluid.

By closing to the flow of fluid through the valve 24, the fluid pressure can be increased upstream of the closure and thereby in the hydraulic jack 14. The fluid pressure will act on the actuator not shown to pull the telescopic element 16 in the direction of the pipe string 4 and thereby pull the end length 6 loose from the cement 12 and away from the rest of the casing 8. When the end length 6 has been removed, the operation is repeated by making a new cut 10 so that a new end length 6 and a new rest of the casing 8 are formed. The downhole tool 1 is brought into a position corresponding to the one shown in FIG. 1 in order to pull the new end length 6 loose. In this way, the casing 8 is removed length by length until the last remainder of the casing 8 can be pulled out in one piece.

Figure 2:
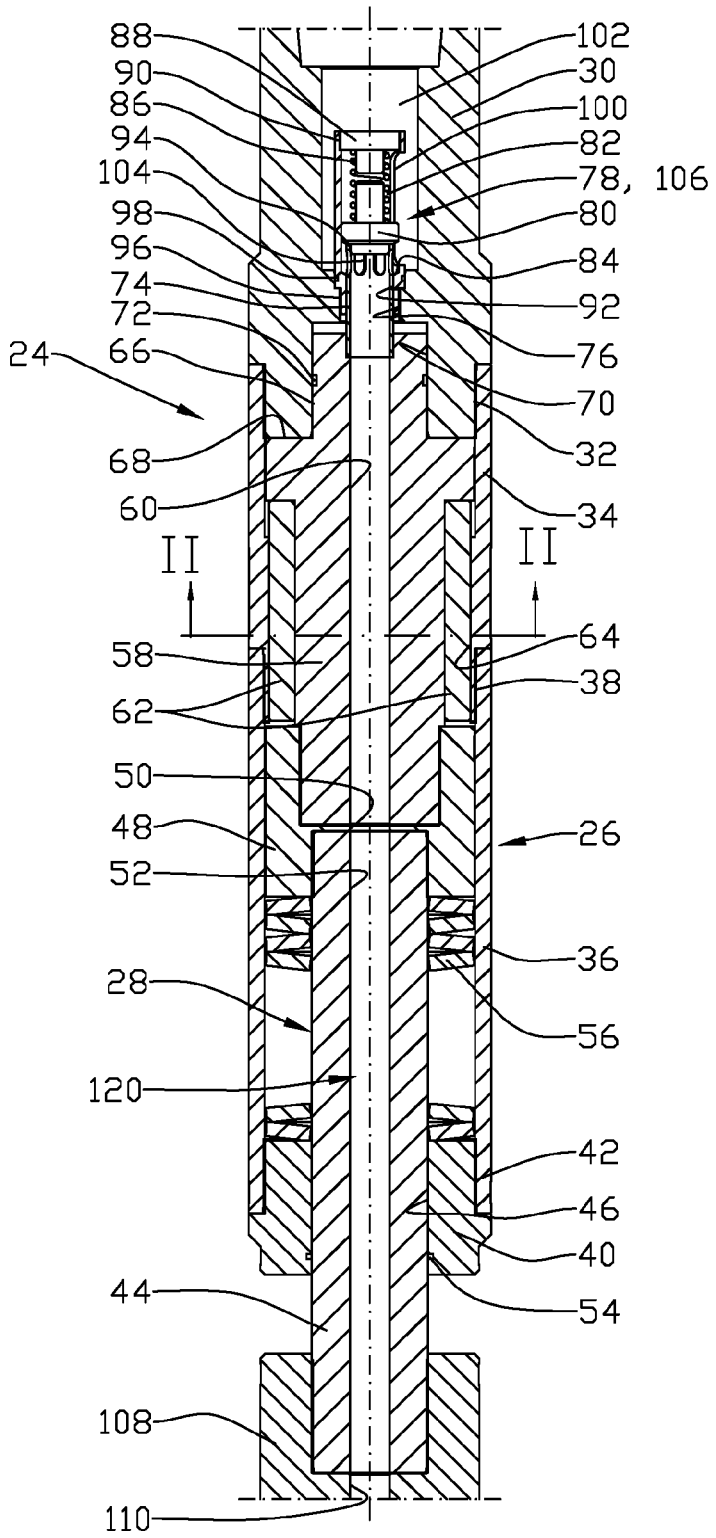
FIG. 2 shows a longitudinal section, on a larger scale, through the valve of FIG. 1, in which an opening and closing mechanism is shown in the open position.
Figure 3:
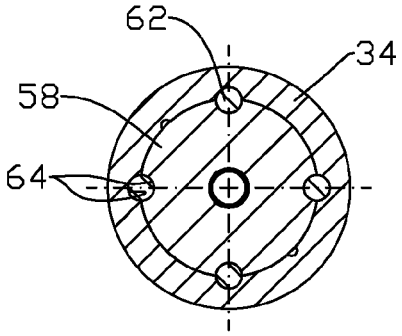
FIG. 3 shows a section II-II of FIG. 2.
Figure 4:
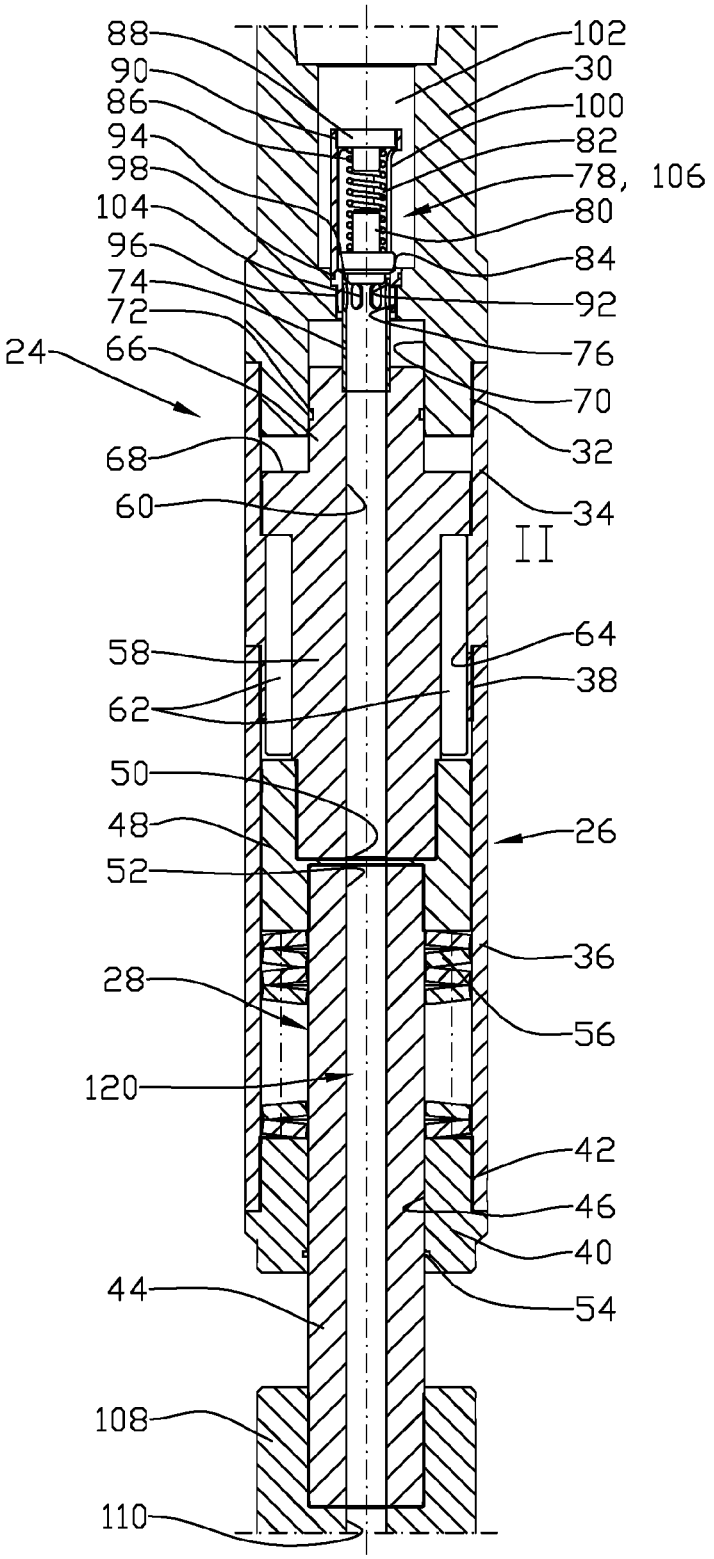
FIG. 4 shows the same as FIG. 2, but the opening and closing mechanism is shown in its closed position.
Figure 5:
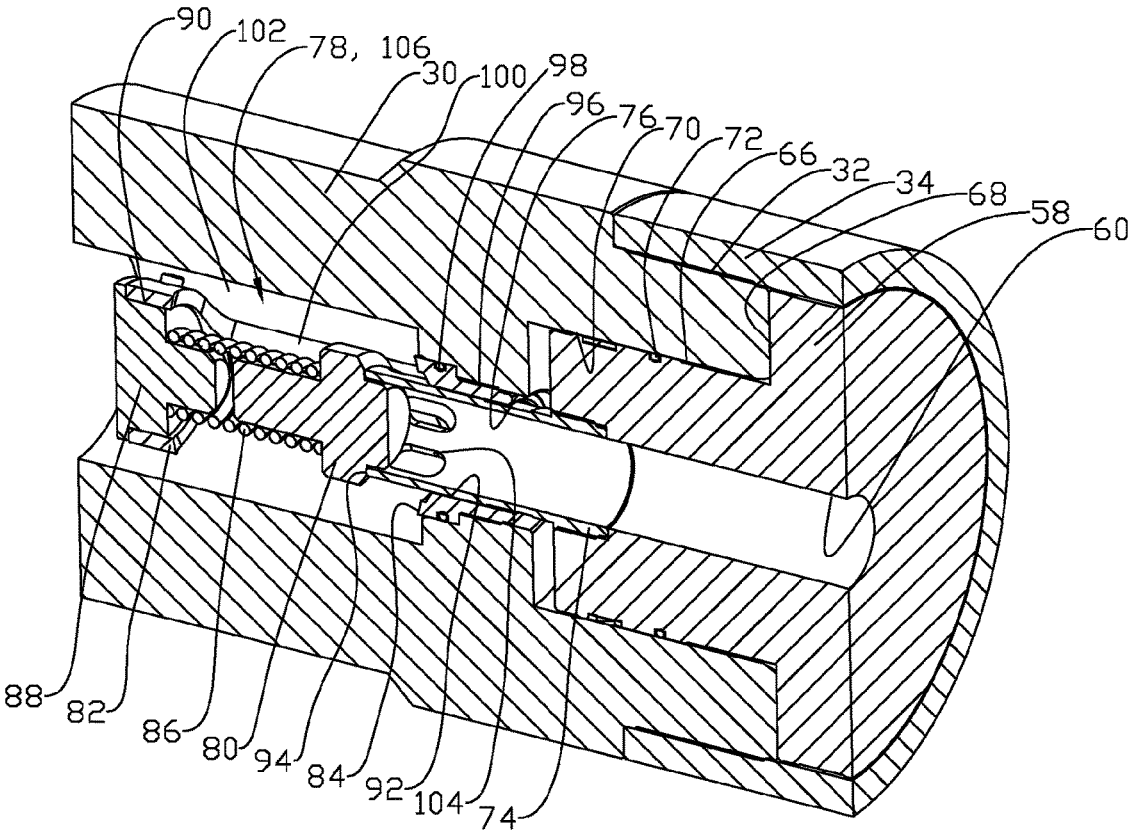
FIG. 5 shows a perspective section, on a larger scale still, of the valve in which the opening and closing mechanism consists of a seat valve, which is in the open position.
Figure 6:
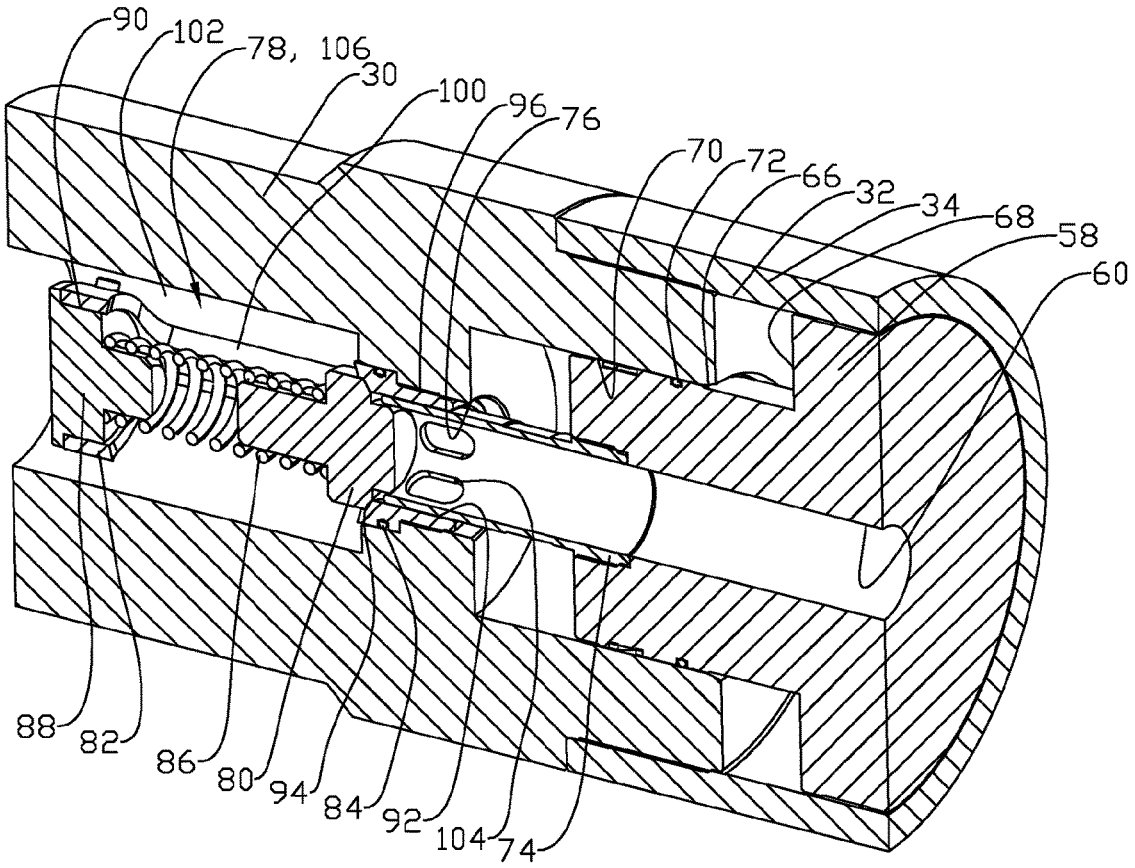
FIG. 6 shows the same as FIG. 5, but the opening and closing mechanism is in the closed position.

The valve 24 is shown in more detail in FIG. 2 and FIG. 4, and parts of the device appear best from FIGS. 3, 5, 6.

The cylindrical first valve portion 26 includes an end piece 30 which, at one end, is arranged to be connected via the hydraulic jack 14 to the pipe string 4 and which, at the other end, has been screwed together with one end of a grooved sleeve 34 by means of a threaded connection 32. At its other end, the grooved sleeve 34 is connected to one end of a spring housing 36 by means of a threaded connection 38. The other end of the spring housing 36 is connected to an end wall 40 by means of a threaded connection 42. In the exemplary embodiment, first valve portion 26 in FIG. 1 thus comprises the end piece 30, the grooved sleeve 34, the spring housing 36 and the end wall 40 as shown in FIG. 2 and in FIG. 4.

The second valve portion 28 includes a telescope pipe 44 extended through a bore 46 at the centre of the end wall 40 into the spring housing 36 where the telescope pipe 44 is attached to one end of a slider 48 which is arranged to be displaced axially in the spring housing 36, the slider 48 centering the end of the telescope pipe 44 in the spring housing 36 at the same time. A bore 50 through the slider 48 forms an extension of a passage 52 in the telescope pipe 44.

A gasket 54 is arranged to provide a sliding seal between the end wall 40 and the telescope pipe 44. A main spring 56 in the spring housing 36, shown here as made from several disc springs, acts between the end wall 40 and the slider 48, and the spring force works to push the slider 48 away from the end wall 40 and thus to move the telescope pipe 44 into the spring housing 36. Disc springs are suitable for providing great spring force with little motion, and by stacking a varying number of disc springs the desired length of stroke can be achieved. It will be understood that disc springs are to fill up the space between the end wall 40 and the slider 48 completely even though the drawing shows only a few disc springs between these elements.

A grooved shaft 58 is arranged to be displaced axially in the grooved sleeve 34.

One end of the grooved shaft 58 is attached to the slider 48. The grooved shaft 58 thereby follows the movements of the slider 48 and the telescope pipe 44 in the longitudinal direction. A bore 60 through the grooved shaft 58 forms a continuous channel with the bore 50 of the slider 48 and the passage 52 of the telescope pipe 44. Floating keys 62 are arranged to fill grooves 64 in the grooved sleeve 34 and in the grooved shaft 58. Said grooves 64 and the floating keys 62 have the effect of making the grooved shaft 58 displaceable in the longitudinal direction inside the grooved sleeve 34, but non-rotatable relative to the grooved sleeve 34. See FIG. 3.

At the other end of the grooved shaft 58, the grooved shaft 58 is stepped down to a supporting portion 66 of a smaller diameter. A shoulder 68 facing in the direction of the end piece 30 is thereby formed. The supporting portion 66 is arranged to be axially displaceable in a complementary bore 70 in the end piece 30. When the grooved shaft 58 is displaced in the grooved sleeve 34, the supporting portion 66 is displaced in the bore 70. A gasket 72 is arranged to provide a sliding seal between the supporting portion 66 and the bore 70.

An actuating sleeve 74, which is sealingly attached to the grooved shaft 58, extends displaceably on into the end piece 30 through a centric, axial hole 76 in the end piece 30.

The second valve portion 28 thus comprises the telescope pipe 44, the slider 48, the grooved shaft 58 and the actuating sleeve 74.

An opening and closing mechanism 78 includes a valve body 80, which is arranged to be moved axially in a valve sleeve 82 and seal against a valve seat 84 in the valve sleeve 82. One end of a pre-tensioned valve spring 86 acts on the valve boy 80 and is arranged to push the valve body 80 towards the valve seat 84, the other end of the valve spring 86 acting against an end plug 88 at one end of the valve sleeve 82. The valve sleeve 82 and the end plug 88 are provided with complementary threads 90 so that the end plug 88 can be screwed into the end of the valve sleeve 82 after the valve body 80 and the valve spring 86 are in place in the valve sleeve 82.

The other end of the valve sleeve 82 is open, so that fluid may flow into or out of the valve sleeve 82 if the valve body 80 is displaced against the force of the valve spring 86 and away from the valve seat 84. An internal sliding portion 92 at the open end of the valve sleeve 82 is arranged to receive the actuating sleeve 74 so that the actuating sleeve 74 may be moved axially in the sliding portion 92 and so that the end face 94 of the actuating sleeve 74 may come into contact with the valve body 80 to displace it against the force from the valve spring 86 and away from the valve seat 84.

The valve sleeve 82 is screwed into the end piece 30 by means of a threaded connection 96. A seal 98 is arranged to seal between the valve sleeve 82 and the end piece 30.

In a portion between the valve seat 84 and the threads in which the end plug 88 is screwed to the valve sleeve 82, the wall of the valve sleeve 82 is provided with at least one opening 100 in which fluid may flow between the interior of the valve sleeve 82 and a chamber 102 having its mouth at the free open end of the end piece 30.

The wall of the actuating sleeve 74 is provided with at least one opening 104 for fluid connection between the outside of the actuating sleeve 74 and the bore 60 of the grooved shaft 58. The components 80, 82, 84, 86 and 36 thus constitute a seat valve 106.

When the main spring 56 pushes the slider 48 and thereby the actuating sleeve 74 towards the opening and closing mechanism 78, the end face 94 of the actuating sleeve 74 hits the valve body 80 and pushes it away from the valve seat 84. At the same time, the openings 104 in the wall of the actuating sleeve 74 are moved past the valve seat 84 and further into the valve sleeve 82, whereby fluid may flow into the end piece 30 to the chamber 102, through the openings 100 in the wall of the valve sleeve 82 and further through the openings 104 in the wall of the actuating sleeve 74, the bore 60 of the grooved shaft 58, through the bore 50 of the slider 48 to the passage 52 in the telescope pipe 44 and out of the open end of the telescope pipe 44, where a coupling piece 108 is arranged, which is arranged to be connected to equipment such as a fishing device 20, see FIG. 1.

In the initial position, see FIG. 2, the pre-tensioned main spring 56 pushes the slider 48 and thereby the grooved shaft 58 with the actuating sleeve 74 in the direction of the opening and closing mechanism 78. The telescope pipe 44 is attached to the slider 48 and is pulled into the spring housing 36, and the end face 94 of the actuating sleeve 74 pushes the valve body 80 towards the valve spring 86 and away from the valve seat 84. The shoulder 68 of the grooved shaft 58 comes into abutment against the end piece 30 which thereby forms an end stop for the axial movement of the grooved shaft 58 in the direction of the end piece 30. In this initial position there is thus a through-going fluid channel from the end piece 30 via the chamber 102, the opening 100 in the valve sleeve 82, the openings 104 in the actuating sleeve 74, the bore 60 of the grooved shaft 58, the bore 50 of the slider 48, the passage 52 of the telescope pipe 44 and a bore 110 in the coupling piece 108.

In the activated state, see FIG. 6, a sufficient tensile force has been applied between the end piece 30 and the coupling piece 108 to overcome the force of the pre-tensioned main spring 56 and thereby pull the telescope pipe 44 and the slider 48 in the direction against the spring 56. The grooved shaft 58 and the actuating sleeve 74 follows the movement of the slider 48 and the valve spring 86 moves the valve body 80 towards the valve seat 84. The opening and closing mechanism 78 closes as the valve body 80 lands on the valve seat 84, and fluid cannot flow in at the end piece 30 and out at the coupling piece 108.

When fluid is pumped through the valve 24 and the opening and closing mechanism 78 is closed by the application of an outer tensile force that exceeds the force of the main spring 56 to the valve 24, the fluid pressure may be increased upstream of the opening and closing mechanism 78 to operate equipment such as the hydraulic jack 14 of FIG. 1.

Figure 7:
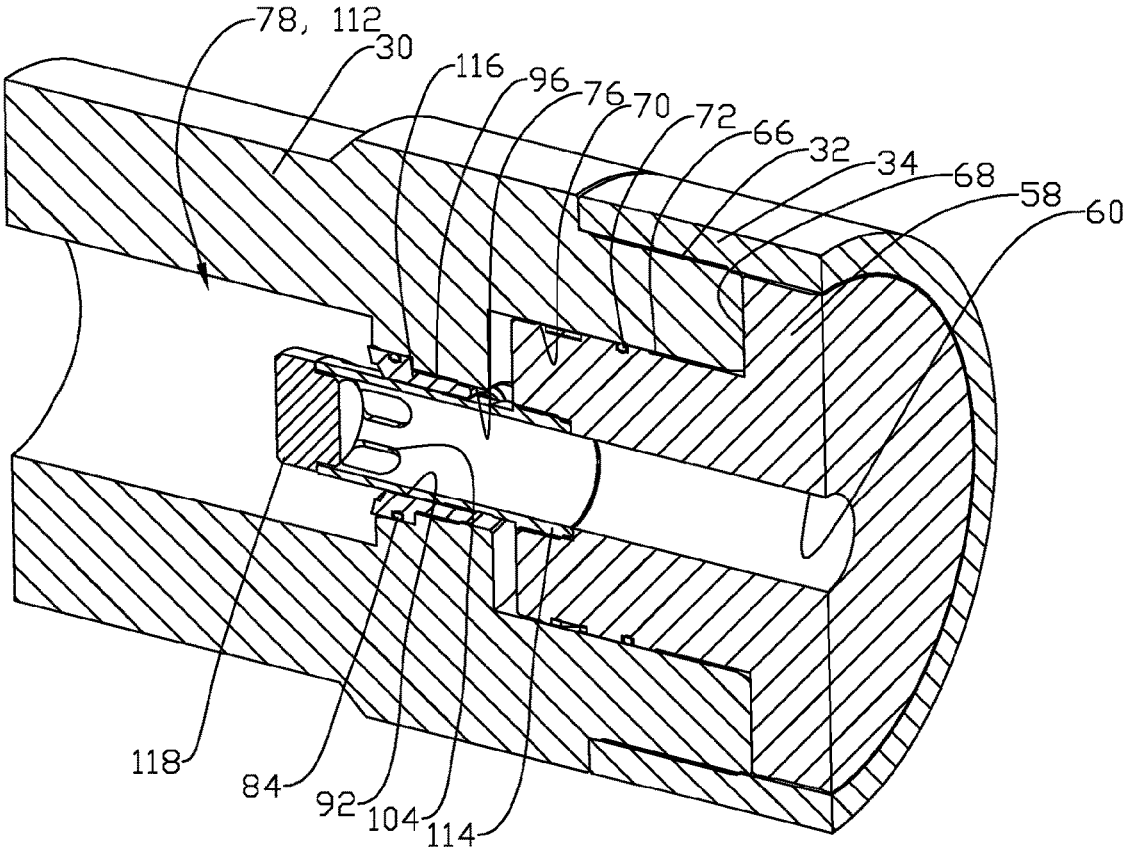
FIG. 7 shows the opening and closing mechanism in an alternative embodiment in which it consists of a slide valve.

In an alternative embodiment, see FIG. 7, the opening and closing mechanism 78 consists of a slide valve 112. The actuating sleeve 74 in the preceding figures has been replaced with a slide-valve sleeve 114 which is formed like the actuating sleeve 74, but which has a relatively fine clearance to a valve ring 116. A fixed plug 118 is sealingly arranged in the end portion of the slide-valve sleeve 114 facing the end piece 30.

In FIG. 7, the opening and closing mechanism 78 is shown in an open position in which fluid may flow through the openings 104 of the slide-valve sleeve 114. When the valve 24 is extended, the openings 104 of the slide-valve sleeve 114 are moved into the valve ring 116 and seal against flow.

A passage 120 in the valve 24 comprises the passage 52, the bore 50, the bore 60, the actuating sleeve 74, the valve sleeve 82 and the chamber 102, or the passage 52, the bore 50, the bore 60, the slide-valve sleeve 114 and the chamber 102.

The invention claimed is:

1. A method of operating a downhole-tool, in which the downhole tool is designed to form part of a pipe string, and in which a valve is provided with a passage for fluid, the passage including an opening and closing mechanism, the method comprising:

connecting a first valve portion to the pipe string;

connecting a second valve portion to a fishing device with a fixing device, the second valve portion being telescopic to be moved axially relative to the first valve portion;

pre-tensioning the first valve portion and the second valve portion by contraction of the downhole tool to an initial position, in which the opening and closing mechanism is open for fluid flow through the pipe string; and displacing the second valve portion relative to the first valve portion by extension of the downhole tool to close the opening and closing mechanism to block fluid flow through the pipe string.

2. The method according to claim 1, wherein displacing the second valve portion relative to the first valve portion by extension of the downhole tool comprises pulling on the pipe string.

3. A downhole tool device which is designed to form part of a pipe string, and in which a valve is provided with a passage for fluid, the passage including an opening and closing mechanism, characterized in that a first valve portion is connected to the pipe string, and a second valve portion is connected to a downhole object fishing device with a fixing device, the second valve portion is telescopic to be moved axially relative to the first valve portion, the first valve portion and the second valve portion being pre-tensioned by contraction of the downhole tool to an initial position in which the opening and closing mechanism is open for fluid flow through the pipe string, a displacement between the first valve portion and the second valve portion by extension of the downhole tool bringing the opening and closing mechanism to close to block fluid flow through the pipe string.

4. The device according to claim 3, characterized in that the opening and closing mechanism consists of a seat valve.

5. The device according to claim 3, characterized in that in one of the valve portions, a valve seat is arranged, and one of the valve portions is designed to keep a valve body at a distance from the valve seat in the initial position, and a displacement between the first valve portion and the second valve portion by extension of the downhole tool has the effect of letting the valve body come into sealing contact with the valve seat.

6. The device according to claim 3, characterized in that the opening and closing mechanism consists of a slide valve.

7. The device according to claim 3, characterized in that the first valve portion and the second valve portion are pre-tensioned by means of a main spring to cause contraction of the downhole tool.

8. The device according to claim 3, characterized in that the first valve portion and the second valve portion are pre-tensioned by means of a hydraulic force to cause contraction of the downhole tool.

9. The device according to claim 3, characterized in that between the first valve portion and the second valve portion, at least one longitudinal floating key is arranged.

10. The device according to claim 3, characterized in that the downhole tool includes a hydraulic jack which, at one end, is connected to surface via the pipe string.

11. A valve having a passage for fluid, including:

a first valve portion including:

a tubular housing including an end piece arranged to be connected to a pipe string;

the end piece having a chamber and a first valve portion bore;

the first valve portion bore providing a centric axial hole with a valve seat;

a second valve portion including:

a telescopic pipe, which can be moved axially in the first valve portion, and being arranged to be connected to a downhole object;

the telescopic pipe including: a second valve portion bore; a supporting portion displaceable into the first valve portion bore; a sleeve sealingly attached to the supporting portion extending displaceably on into the end piece through the centric axial hole in the end piece; and an end plug; and a spring arranged to displace the first valve portion and the second valve portion to an initial contracted position in which the passage for fluid through the valve is open via a fluid connection between at least one opening in a wall of the sleeve and the second valve portion bore;

wherein a displacement between the first valve portion and the second valve portion by pulling of the pipe string and overcoming a force of the spring, extends the valve so that the openings are moved into the first valve portion bore sealing on the valve seat so that fluid cannot flow in at the end piece from the pipe string and out of the second valve portion bore bringing the closing of the passage for fluid through the valve; and wherein the tubular housing further includes a grooved sleeve, the telescopic pipe further includes a grooved shaft, floating keys are arranged to fill grooves in the grooved sleeve and the grooved shaft so that the grooved shaft is displaceable axially in a longitudinal direction inside the grooved sleeve and is non-rotatable relative to the grooved sleeve.

12. The valve according to claim 11 wherein the tubular housing further includes a spring housing including the spring and an end wall, the telescopic pipe extending through an end bore at a center of the end wall and including a slider arranged to be axially displaced in the spring housing wherein the force of the spring acts to push the slider away from the end wall.

13. The valve according to claim 11 wherein the spring is formed from a stack of disc springs.

14. The valve according to claim 11 wherein the valve seat is formed on a valve sleeve which is screwed into the end piece by means of a threaded connection and the valve further includes:

a valve body which is arranged to be moved axially in the valve sleeve and seal against the valve seat;

a valve spring with a first end acting on the valve body to push it towards the valve seat and a second end acting against the end plug which is screwed to an end of the valve sleeve;

an internal sliding portion at an open end of the valve sleeve arranged to receive the sleeve so that an end face of the sleeve can contact the valve body to displace it against a force of the valve spring away from the valve seat; and at least one valve sleeve opening in a wall of the valve sleeve between the end plug and the valve seat so that fluid may flow between an interior of the valve sleeve and the chamber.

15. The valve according to claim 11 wherein the sleeve is a slide-valve sleeve, the valve seat is formed on a valve ring which is screwed into the end piece by means of a threaded connection and the end plug is a fixed plug sealingly arranged in an end portion of the slide-valve sleeve facing the end piece.

16. A method of closing a valve, the valve comprising:

a first valve portion including:

a tubular housing including an end piece arranged to be connected to a pipe string;

the end piece having a chamber and a first valve portion bore;

the first valve portion bore providing a centric axial hole with a valve seat;

a second valve portion including:

a telescopic pipe, which can be moved axially in the first valve portion, and being arranged to be connected to a downhole object;

the telescopic pipe including: a second valve portion bore; a supporting portion displaceable into the first valve portion bore; a sleeve sealingly attached to the supporting portion extending displaceably on into the end piece through the centric axial hole in the end piece; at least one opening in a wall of the sleeve and an end plug; and a spring arranged to displace the first valve portion relative to the second valve portion;

the method including the steps of:

(a) connecting the end piece of the first valve portion to a pipe string;

(b) connecting the telescopic pipe of the second valve portion to a downhole object;

(c) using the spring to displace the first valve portion and the second valve portion to an initial contracted position in which the passage for fluid through the valve is open with the spring pushing a slider and thereby a grooved shaft with the sleeve of the telescopic pipe in the direction of the end piece;

(d) flowing fluid through the valve via the end piece, the openings and the second valve portion bore;

(e) pulling on the pipe string to overcome the force on the spring and extending the valve; and (f) closing the passage for fluid flow through the valve by moving the openings into the first valve portion bore and sealing on the valve seat.

17. The method of closing a valve according to claim 16 wherein in steps (e) and (f) the telescopic pipe is displaced axially in a longitudinal direction being prevented from rotating relative to the tubular housing.

18. The method of closing a valve according to claim 16 wherein in step (c) the slider is pulled into a spring housing and the sleeve of the telescopic pipe is pushed into the end piece to bring the openings into the chamber for fluid flow through the valve.

19. The method of closing a valve according to claim 18 wherein in step (e) the slider of the telescopic pipe is pulled in the direction against the spring, the grooved shaft and sleeve follow the movement of the slider and the openings are moved into a valve ring with the plug seating in the valve seat and seals against flow.

20. The method of closing a valve according to claim 16 wherein in step (c) the slider is pulled into a spring housing and an end face of the sleeve acts on a valve body to push it towards a valve spring away from the valve seat to bring the openings into the chamber for fluid flow through the valve.

21. The method of closing a valve according to claim 20 wherein in step (e) the slider of the telescopic pipe is pulled in the direction against the spring, the grooved shaft and sleeve follow the movement of the slider and the valve spring moves the valve body towards and lands on the valve seat.

* * * * *